United States Patent [19]

Bagnall

[11] Patent Number: 4,669,403

[45] Date of Patent: Jun. 2, 1987

[54] DRIVE FOR A TUFTING MACHINE

[75] Inventor: Arthur Bagnall, Manchester, England

[73] Assignee: Spencer Wright Industries, Inc., Dalton, Ga.

[21] Appl. No.: 887,052

[22] Filed: Jul. 18, 1986

[51] Int. Cl.[4] ..... D05C 15/10; D05C 15/12; D05C 15/20

[52] U.S. Cl. ..... 112/80.4; 112/80.42

[58] Field of Search ..... 112/80.4, 80.42

[56] References Cited

U.S. PATENT DOCUMENTS

| | | | |
|---|---|---|---|
| 3,839,972 | 10/1974 | Scott et al. | 112/80.42 |
| 4,010,700 | 3/1977 | Webb | 112/80.4 X |
| 4,187,788 | 2/1980 | Cobble | 112/80.4 |
| 4,515,096 | 5/1983 | Ingram | 112/80.4 X |
| 4,586,445 | 5/1986 | Card et al. | 112/80.4 X |

*Primary Examiner*—Ronald Feldbaum

*Attorney, Agent, or Firm*—Alan Ruderman

[57] ABSTRACT

A tufting machine has a needle bar drive mechanism including a first shaft on which drive eccentrics are mounted for driving connecting rod means which reciprocate the needle bar push rods and thus the needle bar. A second shaft is mounted adjacent the first shaft and gears mounted on the respective shafts are in meshing engagement with each other so that upon rotation of one shaft the other shaft rotates in the opposite direction. Counterbalancing weights on the needle bar driving shaft are disposed 180° out of phase with the reciprocation of the needle bar, and counterbalancing weights on the other shafts counterbalance the rotational forces of the needle bar driving shaft. The other shaft is drivingly rotated by the tufting machine motor and also carries the hook and knife drive eccentrics. The construction is such that the reciprocating and rotating forces are counterbalanced by the two shafts.

4 Claims, 5 Drawing Figures

DRIVE FOR A TUFTING MACHINE

BACKGROUND OF THE INVENTION

This invention relates to tufting machines and more particularly to a drive for driving the tufting instrumentalities in a tufting machine at very high speeds.

In the art of tufting one or more rows of yarn carrying needles are reciprocably driven through a base material fed through the machine to form loops that are seized by loopers or hooks oscillating below the base material in timed relationship with the needles.

The needles are typically mounted in a needle bar supported at the end of a plurality of push rods constrained for reciprocatory motion toward and away from the loopers or hooks. In those machines having a sliding needle bar arrangement, i.e., wherein the needle bar is controllably driven by pattern means transverse to the direction of movement of the backing material a needle bar carrier supports the needle bar, the carrier being secured to the push rod and moving therewith and permitting the needle bar to reciprocate with the push rods yet slide relatively to the push rods.

Conventionally reciprocating motion of the push rods have been effected by various types of drives generally of two types, namely an eccentric cam mounted on a rotation shaft and connected to the push rods through an eccentric strap and connecting means, or the push rods have been driven by a linkage arrangement connected to a rock shaft which in turn is driven by a lever connected to an eccentrically mounted circular cam. An example of the former construction is illustrated in Ingram et al. U.S. Pat. No. 3,964,407, and an example of the latter is illustrated in Cobble U.S. Pat. No. 2,977,905, and in numerous other of the patented art. The loopers or hooks and in the case of cut pile machines, the knives, are also driven from mechanism such as sprockets mounted on the end of the main shaft and drivingly connected to the looper or hook and knife rock shafts mounted in the bed of the tufting machine. In such prior art drives all of the tufting instrumentalities are driven directly off the main shaft.

The speed of tufting machines have been increased substantially as the tufting art has gradually developed. As the speeds increase above 1000 rpm those machines of the linkage driven type having levers and rocker arms tend to wear more rapidly, and additionally, because of the lever arms used there is a large tortional moment exerted on the rocker shaft especially at the top and bottom of the stroke. The oscillating movements of the levers in such linkage machines are more difficult to balance than a rotating system utilizing an eccentric cam drive. However, one problem that arises with cam drives is the presence of unbalanced forces that are associated with the larger cams. The unbalanced forces require the use of counterbalancing weights, which, in turn, increase the amount of rotating mass in the drive line placing excessive stress on machine parts and limiting the speed of the machine. Consequently, in both types of drives used in single shaft tufting machines the speeds have been limited.

One approach to this problem is that illustrated in Ingram U S. Pat. No. 4,515,096 which illustrates a counterbalancing system in an eccentric cam driven machine. There additional eccentrics mounted 180° out of phase with the eccentrics which drive the push rods are mounted on a common shaft. Although this approach not only balanced the rotating and oscillating systems, it also balanced the needle reciprocation system.

Another approach, which is illustrated in Scott et al. U.S. Pat. No. 3,839,972, was to utilize an adjustable crank shaft in which the crank and connecting rods that drive the push rods could be positioned relatively to the axis of the crank shaft. Balancing of the rotating system was attained by utilizing counter-weights at ends of the stub shafts to counterbalance the eccentricity of the crank. In linkage driven systems, a counterbalancing rocker shaft is included within the head of the machine and includes additional slotted levers driven by eccentric cams out of phase with the needle drive eccentric cams. Thus, with the exception of Ingram U.S. Pat. No. 4,515,096 only the rotating and oscillating system was balanced, and not the needle reciprocation system.

A proposal was previously made to mount the push rods and eccentric crank drives therefor on a separate shaft and drive that shaft by timing chains or belts from the mainshaft, the latter being driven by the tufting machine motor. In another recent proposal a number of stub shafts each mounting an eccentric thereon and driving a separate push rod was mounted in the head of the tufting machine with each stub shaft being driven by belts from the mainshaft. In these approaches the mainshaft and the shaft or shafts which drive the push rods rotate in the same direction. Any counterbalancing of the reciprocating system has to be accomplished in a manner similar to that disclosed in Ingram U.S. Pat. No. 4,515,096, i.e., mounting weights on the push rod driving shaft. However, the mounting of additional weights on the push rod driving shafts increases the mass of the push rod system and places excessive forces on the bearings. In the proposal utilizing separate stub shafts for each push rod, the stub shafts effectively are cantilevered and additional weight on the stub shaft would excessively load the bearings.

In view of the need to have tufting machines operate at the highest possible speeds the load on the needle bar/push rod drive system must be minimized so as to reduce the inertia problems, while counterbalancing the entire system against excessive dynamic forces, including the torsional forces.

SUMMARY OF THE INVENTION

Consequently, it is a primary object of the present invention to provide a tufting machine having the tufting instrumentalities driven by a balanced drive mechanism thereby permitting the machine to operate at extremely high speeds.

It is another object of the present invention to provide a drive mechanism for the tufting instrumentalities of a tufting machine, the mechanism including two counter-rotating shafts, one of the shafts carrying the needle bar drive eccentrics and both shafts carrying counterbalancing means for balancing the reciprocating and rotating masses.

It is a further object of the present invention to provide a tufting machine having its tufting instrumentalities driven by a balanced drive mechanism, the drive mechanism having a first shaft driven in one direction and a second shaft driven in the opposite direction thereto, the first shaft being drivingly connected to the push rods for reciprocating the needle bar and the needles carried thereby, both shafts having balancing means for counterbalancing the forces of the reciprocating mechanism and for counterbalancing the rotating forces of the other shaft.

Accordingly, the present invention provides a tufting machine having a needle bar drive including a first shaft carrying eccentrically mounted cam for drivingly reciprocating the needle bar and rotatable in a first direction, and a second shaft rotatably interconnected to the first shaft and rotatable in the direction opposite to the first shaft, each shaft having counterbalancing means disposed out of phase with the reciprocation of the needle bar. Thus, when the needle bar is at top dead center the forces of the counterbalancing means is directed downwardly and visa versa when the needle bar is at bottom dead center. Because the shafts are counter-rotating the horizontal counterbalancing forces on the first shaft are counterbalanced by those on the second shaft.

In the preferred form of the invention the shafts are drivingly connected together by gears mounted on the respective shaft. The drive shaft or main shaft may be driven by conventional motor drive means and carry the looper or hook and the knife drive eccentrics while the other shaft carries the needle stroke eccentrics, i.e., the needle bar drive eccentrics. Both shafts carry counterbalancing means in the form of small weights which counterbalance the reciprocating mass and because of the counter-rotation of the shafts, the counterbalancing weights also counterbalance the rotating mass. Thus, the tufting machine drive system is balanced by means of weights carried on two counter-rotating shafts.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 4:
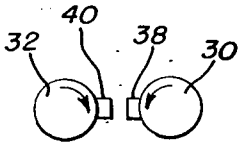
FIG. 4 is a schematic view of the drive system shafts and counterbalancing weights in one of the positions wherein the needle bar is intermediate the top dead center and bottom dead center positions e.g., the needle bar moving up.

Referring now to the drawings, the portions of a tufting machine 10 relevant to the present invention are illustrated including a housing 12 having a head 14 at the upper portion thereof. Mounted within the head for vertical reciprocation is a needle bar 16 carrying a plurality of needles 18 which carry yarn (not illustrated) and cooperate with loopers or hooks (not illustrated) mounted in the bed 20 beneath the bed plate 21 of the tufting machine. The needle bar 16 is supported by support feet 20 carried at the lower end of respective push rods 22 carried in bushing assemblies illustrated schematically at 23 in FIG. 3. A connecting rod 24 in the form of an eccentric strap or pitman is pivotably connected at its lower end to each respective push rod 22 by means of a clevis 26. The upper end of the connecting rod is journally connected about an eccentric 28, i.e., a cam mounted eccentrically on a shaft 30.

Conventionally, the shaft 30 would be the main shaft of the machine and driven at its ends by power drive means including the tufting machine driving motor. However, in accordance with the present invention another shaft 32 is mounted adjacent the shaft 30, and in accordance with the preferred embodiment is the main shaft which is driven at its ends by the conventional motor 33 of the tufting machine. Preferably, the hook and knife eccentrics 34, 35 are mounted on the main shaft 32. In accordance with the principles of the present invention gears 36 are mounted at various locations along the length of the shaft 32 and mesh with respective gears 37 mounted on the shaft 30. The gears 36, 37 preferably are helical gears. Thus, rotation of the shaft 32 results in rotation of the shaft 30 in the opposite direction to the rotation of the shaft 32.

Figure 5:
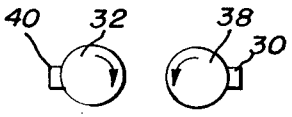
FIG. 5 is a view similar to FIG. 4 illustrating the elements in another intermediate position; e.g., the needle bar moving down.
Figure 3:
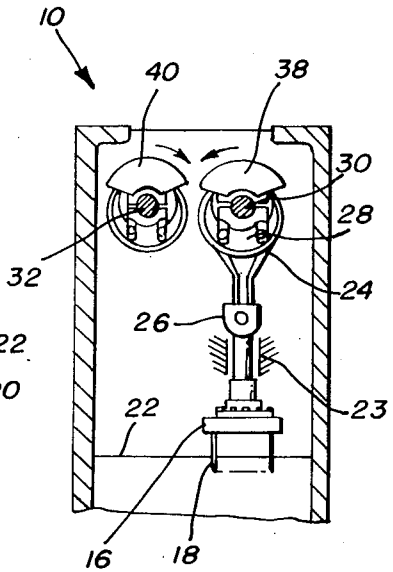
FIG. 3 is a vertical cross sectional view taken substantially along line 3—3 of FIG. 2.
Figure 1:
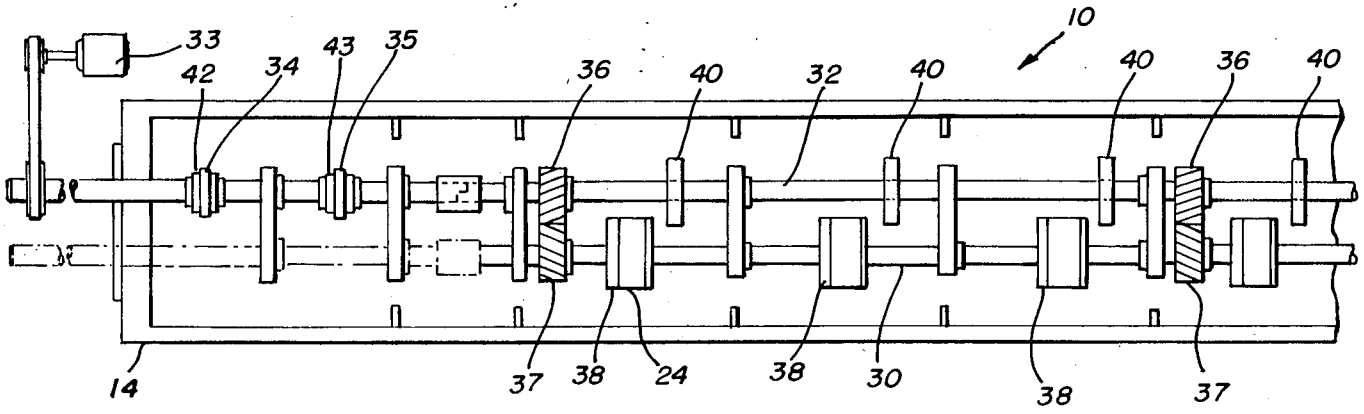
FIG. 1 is a top plan view of the head of the housing with the top cover removed of a tufting machine incorporating the principles of the present invention, the needle bar being substantially at the bottom dead center position.
Figure 2:
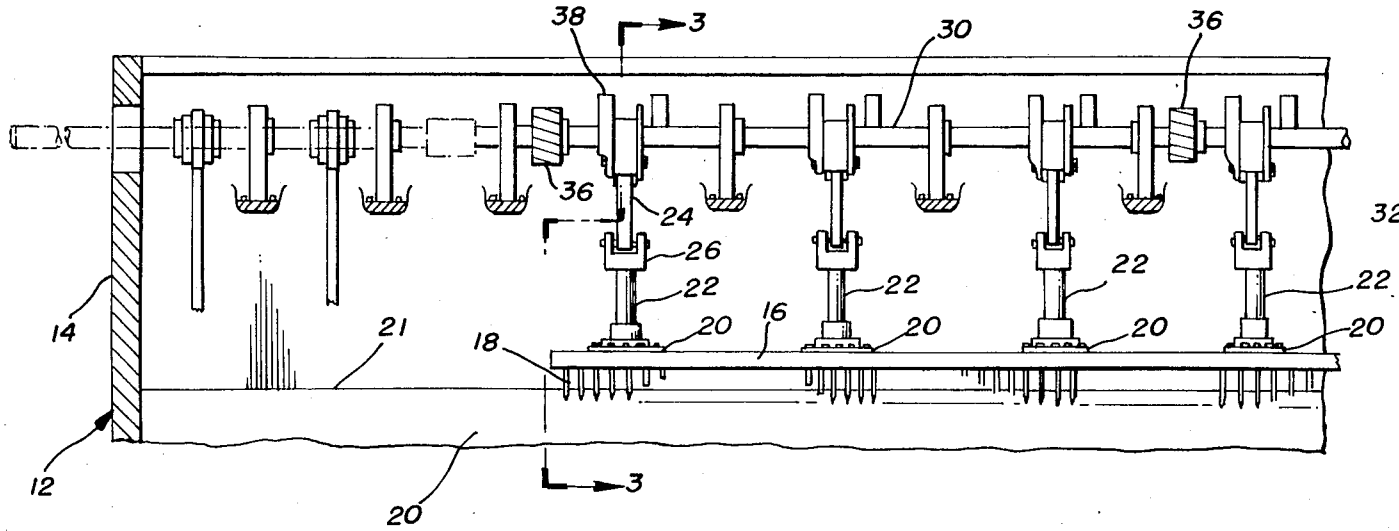
FIG. 2 is a transverse fragmentary vertical cross sectional view taken substantially through the tufting machine of FIG. 1, the hooks and knives being omitted for clarity and ease of presentation.

Mounted at various locations along the shaft 30 are counterbalancing weights 38. Preferably the weights 38 are mounted adjacent to the eccentrics 28 and connecting rods 24, although the specific location can be varied. The weights 38, however, are disposed 180° out of phase with the reciprocation of the push rods 22 and the needle bar 16. Thus, the weights 38 are disposed above the shaft 30 when the needle bar 16 is at its lowermost or bottom dead center position, and are disposed below the shaft 30 when the needle bar is at its uppermost or top dead center position. Disposed on the shaft 32 are a plurality of counterbalancing weights 40 disposed in phase with the weights 38. Consequently, as illustrated in FIG. 3, the weights 40 are at its uppermost position above the shaft 32 when the weights 38 are at their uppermost position above the shaft 30 when the needle bar 16 is at bottom dead center. Similarly when the needle bar is at top dead center the weights 40 are disposed at their lowermost position below the shaft 32. The intermediate positions are illustrated in FIGS. 4 and 5 and indicate the balancing of the rotational forces. The location of the weights 40 along the longitudinal length of the shaft 32 is not, however, critical. Additional weights 42, 43 are mounted adjacent the hook and knife eccentrics 34,35 for balancing the forces created thereby.

Because the shafts 30 and 32 are rotating oppositely to each other, as the needle bar begins moving upwardly from the bottom dead center position and downwardly from the top dead center position, the weights 38 and 40 move toward or away from each other to apply counter-acting forces relative to one another. Thus, the dynamic forces of the rotating system are always balanced horizontally, i.e., the rotating forces of the shaft 30 and the weights 38 thereon are counterbalanced by the rotating forces on the shaft 32 by means of the weights 40. Consequently, not only is the reciprocating force of the needle bar moving system counterbalanced in the plane of reciprocation, but the rotating forces are also balanced by means of the weights on the counter rotating shafts. With this system, depending upon the stroke of the needle bar and needles, reciprocation of the needle bar in the order of 1500 rpm is obtainable with minimum unbalanced forces, and the vibrations associated therewith. The exact number of weights 38 and weights 40 obviously depends on the transverse length of the tufting machine, and thus the shafts 30 and 32, and the weight of the system being reciprocated and rotated. It may be noted that the knife and hook, or looper eccentrics can be mounted on either shaft 32 or shaft 30 suitably extended.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a frame including a head and a bed disposed below said head, a needle bar mounted in said head for reciprocatory movement toward and away from said bed, a drive mechanism for driving said needle bar, said drive mechanism comprising, a first shaft journalled in said head for rotation about an axis, cam means eccentrically mounted on said first shaft at spaced locations, connecting rod means connected to a respective cam means, interconnecting means operatively connecting said connecting rod means to said needle bar whereby rotation of said first shaft causes said needle bar to reciprocate, a second shaft journalled in said head for rotation about a second axis, rotation transferring means mounted on said first and second shafts for drivingly rotating one of said shafts upon rotation of the other of said shafts, said rotation transferring means acting to rotate said one of said shafts in a direction opposite to the direction of rotation of said other of said shafts and equal in rotational speed, counterbalancing means mounted on said first shaft at a disposition 180° out of phase with the eccentricity of said cam means and the reciprocation of said needle bar for counterbalancing the reciprocating forces, counterbalancing means mounted on said second shaft at a disposition 180° out of phase with the eccentricity of said cam means and the reciprocation of said needle bar for counter- balancing the rotational forces on said first shaft, and power means for rotatably driving one of said first and second shafts.

2. In a tufting machine as recited in claim 1, wherein said rotation transferring means comprises gears on said first shaft in meshing engagement with respective gears on said second shaft.

3. In a tufting machine as recited in claim 2, wherein said power means is connected for rotatably driving said second shaft, and said rotation transferring means acts to drive said first shaft upon rotation of said second shaft.

4. In a tufting machine as recited in claim 2, wherein said power means is connected for rotatably driving said first shaft, and said rotation transferring means acts to drive said second shaft upon rotation of said first shaft.

* * * * *